United States Patent [19]

Maruyama et al.

[11] Patent Number: 4,459,090

[45] Date of Patent: Jul. 10, 1984

[54] ROTARY TYPE COMPRESSOR FOR AUTOMOTIVE AIR CONDITIONERS

[75] Inventors: Teruo Maruyama, Neyagawa; Shinya Yamauchi, Katano; Nobuo Kagoroku, Otsu; Yoshikazu Abe, Neyagawa, all of Japan

[73] Assignee: Matsushita Electric Industrial Co., Ltd., Osaka, Japan

[21] Appl. No.: 368,701

[22] Filed: Apr. 15, 1982

[30] Foreign Application Priority Data

Apr. 24, 1981 [JP] Japan ..... 56-62875

[51] Int. Cl.[3] ..... F01C 1/00

[52] U.S. Cl. ..... 418/259; 418/238

[58] Field of Search ..... 418/150, 236–238, 418/259, 266, 268

[56] References Cited

U.S. PATENT DOCUMENTS 3,711,227 1/1973 Schmitz ..... 418/268

4,299,097 11/1981 Shank ..... 418/150

*Primary Examiner*—Leonard E. Smith

*Assistant Examiner*—Jane E. Obee

*Attorney, Agent, or Firm*—Stevens, Davis, Miller & Mosher

[57] ABSTRACT

A compressor adapted for capacity control includes a rotor mounting thereon vanes slidably, a cylinder receiving therein the rotor and the vanes, side plates secured to the opposite sides of the cylinder, a vane chamber defined by the vane, rotor and the cylinder and closed at its sides by the side plates, suction ports and a discharge port. Suction loss produced when the pressure within the vane chamber becomes below the pressure of the refrigerant supply source during a suction stroke is utilized for suppressing the refrigerating capacity of the compressor at high speed operation. With the arrangement of the compressor, the effective area of the flow passage leading to the vane chamber from the suction ports varies in at least two stages such that it becomes smaller in the latter half of the suction stroke than in the former half thereof. Thus, in the compressor, driving torque can be reduced at low speed operation and adequate effects of capacity control can be obtained at high speed operation.

2 Claims, 25 Drawing Figures

ROTARY TYPE COMPRESSOR FOR AUTOMOTIVE AIR CONDITIONERS

BACKGROUND OF THE INVENTION

The present invention relates to a rotary compressor and, more particularly, to the control of refrigeration power of an air conditioning system employing a rotary compressor.

Ordinary rotary compressors of the sliding vane type are finding spreading use as compressors of automobile air conditioners, because of a compact and simple construction as compared with conventional reciprocating type compressors which have a large number of parts and complicated construction. In comparison with the reciprocating type compressors, however, the known sliding vane type rotary compressors suffer the following disadvantages.

Namely, when such a rotary compressor is used as a compressor of an automobile air conditioner, the rotary shaft of the compressor is driven by the power of the engine through a clutch having a pulley which is driven by the engine power via a belt. Therefore, the refrigerating capacity of the air conditioner employing the sliding vane type compressor is increased substantially linearly in proportion to the speed of the engine.

On the other hand, when the reciprocating type compressor is used as a compressor for an automobile air conditioner, the suction valve of the compressor cannot satisfactorily follow up the operation of the compressor particularly at high operation speeds which impedes the sucking of refrigerant gas into the cylinders. In consequence, the refrigerating capacity is saturated when the operation speed of the compressor is increased beyond a predetermined speed. In other words, the excessive increase of the refrigerating capacity is automatically suppressed during high speed running of the automobile in an air conditioner employing a reciprocating type compressor. Such an automatic suppressing function cannot be performed by the rotary compressor. Therefore, in an automobile air conditioner employing the rotary type compressor, the efficiency is inconveniently lowered due to an increase of the compression work, or the air is cooled excessively, during high speed running of the automobile.

In order to avoid the above-described problem of the rotary compressor, it has been proposed to provide a control valve in a passage leading to a suction port formed in one of the side walls of the compressor, the control valve being adjusted to vary the opening area of the passage in relation to the engine speed such that the opening area is reduced as the engine speed is increased, thereby to control the refrigerating capacity. This arrangement, however, requires an additional installation of the control valve, which in turn complicates the construction and raises the production cost.

As another measure for eliminating the drawback of the rotary compressor, i.e. excessive refrigerating capacity at high speed operation, it has been proposed also to adopt such a construction as adapted to prevent the operation speed from being increased above a predetermined speed, by employing a fluid clutch, planetary gear system and so forth. The construction employing the fluid clutch, however, is accompanied by a loss of energy due to generation of heat at the relatively moving surfaces. On the other hand, the construction incorporating the planetary gear system makes the size of the compressor large due to the addition of the planetary gear system having a large number of parts. This goes quite contrary to the current demand for simplification of compressor and reduction of the size of the same to cope with the requirement saving of energy.

SUMMARY OF THE INVENTION

In order to overcome the above-described problems encountered when rotary compressors are put into practical use as the compressor of an automobile air conditioner, the present inventors have already found out that a self-suppression of the refrigeraring capacity at high speed operation can be achieved also by the rotary compressor equally in the case of reciprocating type compressors, provided that the parameters such as suction passage area, rate of discharge and the number of vanes are suitably selected and combined, as proposed in Japanese Patent Application No. 134048/1980.

Also, the present inventors have found that capacity control characteristics in terms of volumetric efficiency becomes most favorable in the construction of a compressor in which an effective suction area in the suction stroke is constant, as proposed in Japanese Patent Application No. 12427/1981.

The present invention provides a rotary compressor in which an adequate refrigerating capacity can be obtained without increasing the power consumption any more than needed even when the number of revolutions on the driving side of the compressor varies widely.

The present invention is directed to improving the compressor, as disclosed in the above Japanese patent applications, which has a capacity control.

According to the present invention, as a result of an investigation of the general characteristics of a compressor including its volumetric efficiency and power consumption, the effective suction area of the compressor is caused to vary in at least two stages such that it is appropriately set in the former and latter stages, thereby reducing the driving torque at low speed operation and providing an adequate capacity control at high speed operation. The present invention makes a great contribution to industries in applications to refrigerating cycles for automobile air conditions. In particular, the present invention can be applied in refrigerating cycles for compressors in which the following features or functions are required:

(1) The refrigerating capacity loss is small at low speed operation, and the refrigerating capacity is effectively suppressed at high speed operation.

(2) The loss of compression work is small and driving is performed at small torque.

(3) There are no mechanical moving parts to provide high reliability.

DESCRIPTION OF THE PREFERRED EMBODIMENTS

Figure 1:
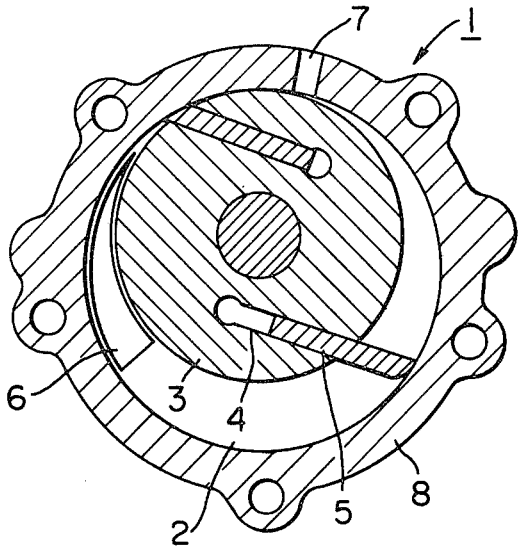
FIG. 1 is a front elevational sectional view of an ordinary sliding vane type rotary compressor.

Referring to FIG. 1 showing an ordinary sliding vane type rotary compressor, a cylinder 8 has a cylindrical space therein. Side plates (not shown in FIG. 1) are secured to both sides of the cylinder 8 so as to close both sides of vane chambers 2 defined in the cylinder 8. A rotor 3 is eccentrically disposed in the cylinder 8. The rotor 3 is provided with grooves 4 which slidably receive vanes 5. A suction port 6 and a discharge port 7 are formed in the side plates. As the rotor 3 rotates, the vanes 3 project radially outwardly due to centrifugal force to make a sliding contact with the inner peripheral surface of the cylinder 8 thereby to prevent the internal leakage of the gas in the compressor.

Figure 2:
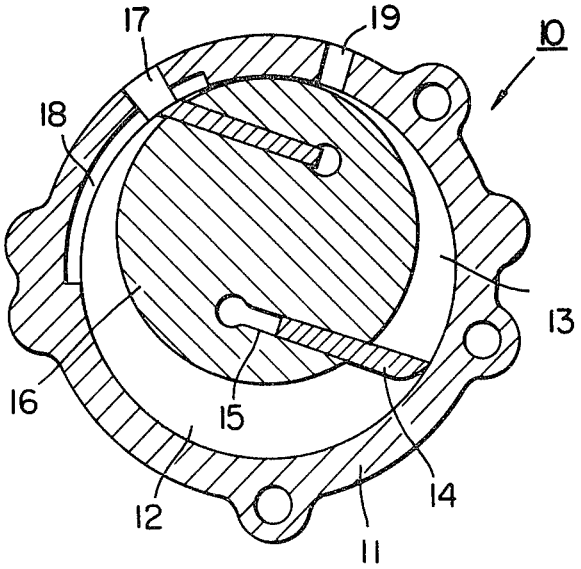
FIG. 2 is a front elevational sectional view of a rotary compressor in accordance with an embodiment of the invention.
Figure 3:
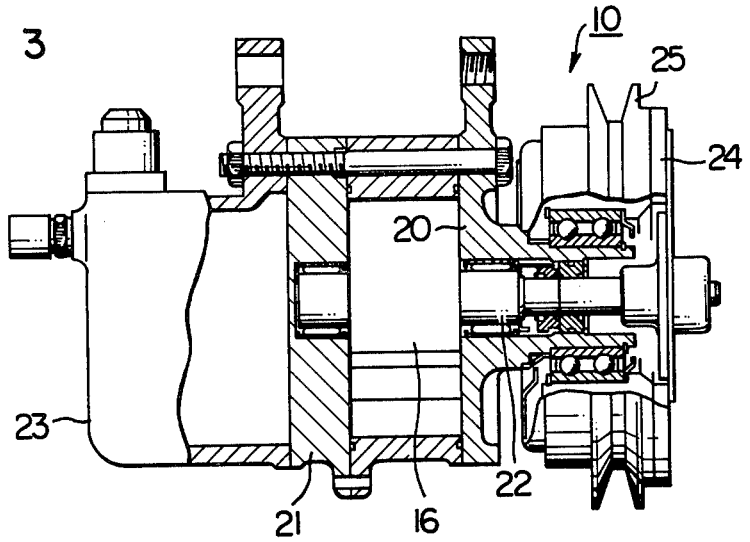
FIG. 3 is a side elevational sectional view of the rotary compressor shown in FIG. 2.

FIGS. 2 and 3 show a sliding vane type rotary compressor 10 constructed in accordance with an embodiment of the invention. This compressor has a cylinder 11, low-pressure vane chamber 12, high-pressure vane chamber 13, vanes 14, vane grooves 15, rotor 16, suction port 17, suction groove 18 formed in the inner peripheral surface of the cylinder 11 and a discharge port 19.

Referring first to FIG. 3, the compressor 10 further has a front panel 20 and a gear panel 21 which constitute the side plates of the compressor, a rotor shaft 22, a rear case 23, a clutch disc 24 fixed to the rotor shaft 22, and a pulley 25.

The compressor according to the embodiment of the present invention as shown in FIG. 2 has the following specifications:

TABLE 1

| Parameters | | Symbols | Embodiment |
|---|---|---|---|
| Number of vanes | | n | 2 |
| Effective area of suction passage | Sucking condition (I) | $a_1$ | 0.60 $cm^2$ |
| | Sucking condition (II) | $a_2$ | 0.42 $cm^2$ |
| Theoretical discharge rate | | V th | 94 cc/rev |
| Angular position of vane at which sucking is completed | | $\theta_s$ | 270° |
| Cylinder width | | b | 38.6 mm |
| Cylinder inner dia. | | Rc | 35.8 $mm^R$ |
| Rotor radius | | Rr | 28.8 $mm^R$ |

Figure 4A:
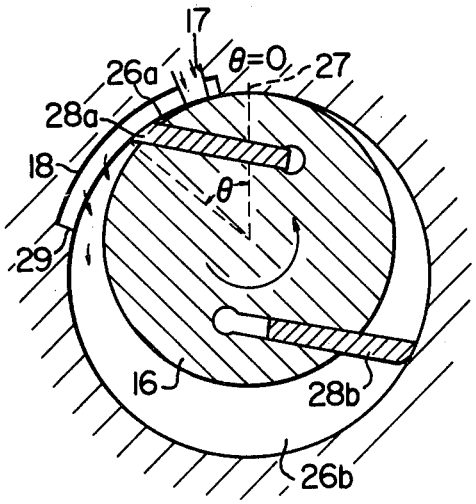
FIG. 4A is a drawing showing the relative positions between vanes and rotor in the state immediately after commencement a suction stroke.

In Table 1 above, the angle $\theta_s$ at which the vane end stops the sucking is determined as follows. Referring to FIG. 4A, reference numeral 26a denotes a vane chamber A, 26b denotes a vane chamber B, 27 denotes the top portion of the cylinder 11, 28a denotes a vane A, 28b denotes a vane B and 29 denotes the end of the suction groove.

With the center being positioned on the axis of rotation of the rotor 16, the angular position of each vane is represented by $\theta$. The position $\theta$ is determined as $\theta=0°$, when the vane end passes the top portion 27 of the cylinder. As to the vane chamber 26a, FIG. 4A shows the state in which the vane 28a has just passed the suction port 17, i.e. the state immediately after the start of the suction stroke. A refrigerant is sucked into the vane chamber 26a directly through the suction port 17 and into the vane chamber 26b via the suction groove 18 as indicated by arrows.

Figure 4B:
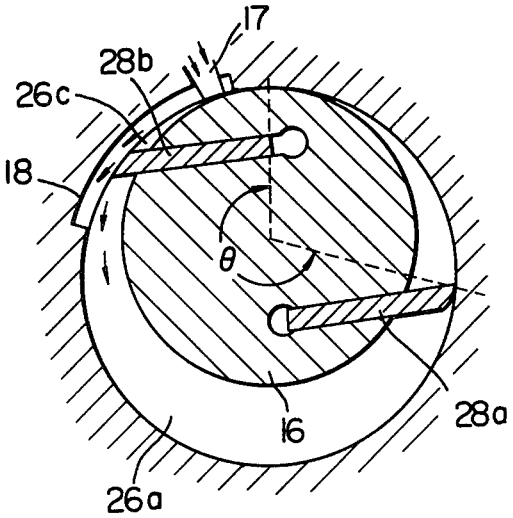
FIG.4B shows the relative positions between vanes and rotor in the state before the completion of the suction stroke.

FIG. 4B shows the state before the completion of the suction stroke. In this state, the refrigerant is fed to the vane chamber 26a through a gap between the vane 28b and the suction groove 18.

Figure 4C:
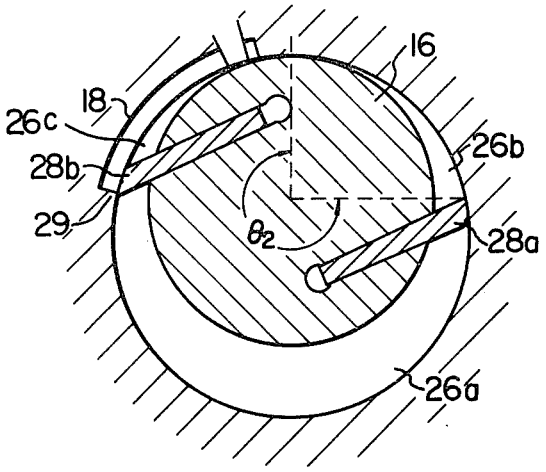
FIG. 4C shows the relative positions between vanes and rotor in the state at the completion of the suction stroke.

FIG. 4C shows the state immediately after the completion of suction stroke of the vane chamber 26a. In this state, the end of the vane 28b is positioned to face the end 29 of the suction groove. At this position, the vane chamber 26a defined by the vane 28a and vane 28b takes the maximum volume.

Figure 5A:
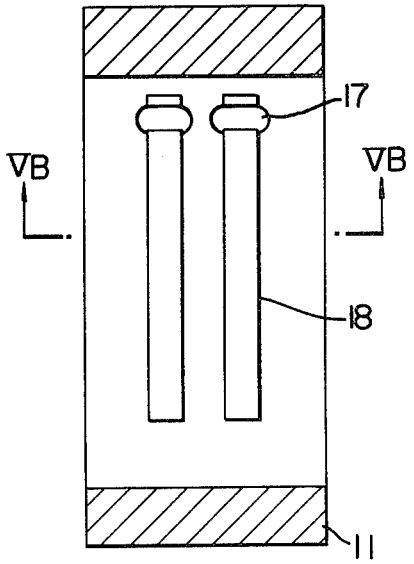
FIG. 5A shows the configuration of the suction port of the rotary compressor shown in FIG. 2.
Figure 5B:
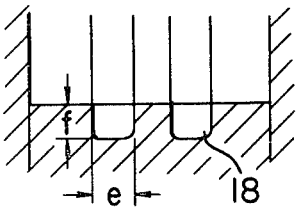
FIG. 5B is a sectional view taken along the line VB—VB of FIG. 5A.

FIGS. 5A and 5B show how the suction groove 18 is formed in the inner peripheral surface of the cylinder 11 in the embodiment shown in FIG. 2.

Figure 6:
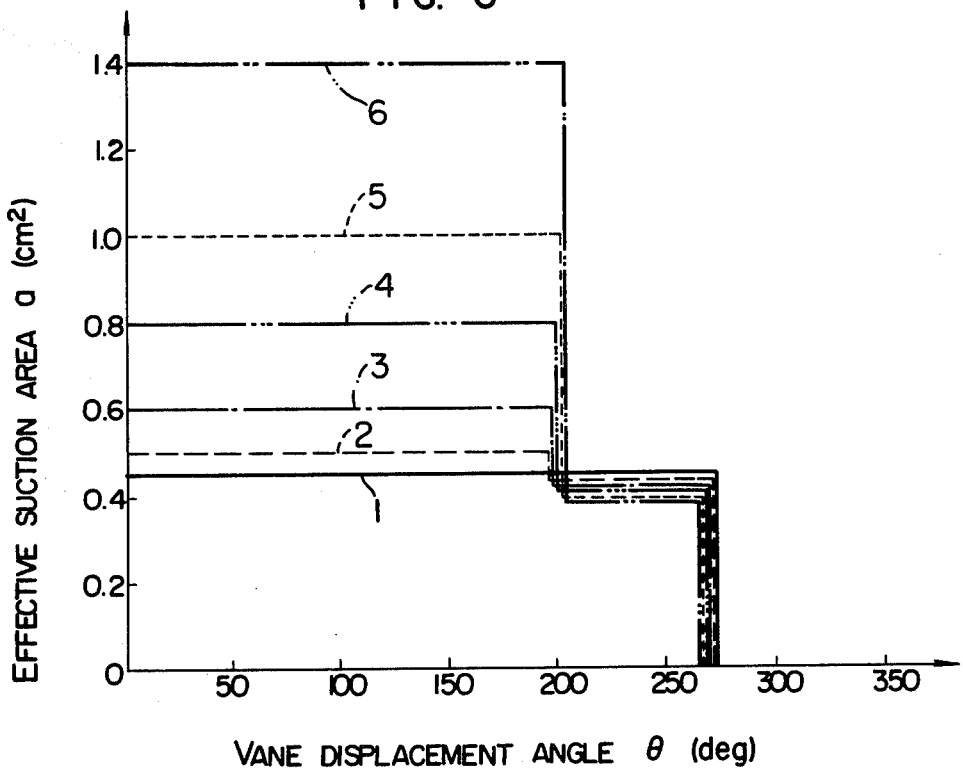
FIG. 6 shows a relationship between an effective suction passage area and vane displacement angle.

FIG. 6 and Table 2 illustrates vane displacement angle $\theta$ relative to the effective suction area a for different patterns 1 to 6. The pattern 3 corresponds to the embodiment as shown in Table 1.

TABLE 2

| Pattern | Effective suction area in the former stage | Effective suction area in the latter stage |
|---|---|---|
| 1 | 0.450 $cm^2$ constant | |
| 2 | 0.50 | 0.435 |
| 3 | 0.60 | 0.420 |
| 4 | 0.80 | 0.410 |
| 5 | 1.00 | 0.390 |
| 6 | 1.40 | 0.385 |

In pattern 1, the effective suction area a is constant throughout suction stroke. This state of condition is provided by the arrangement in which a sectional area ($S=2\times e\times f$) of the suction groove 18 is made sufficiently large with respect to the area of the suction port 17 (see FIG. 5B).

In patterns 2 to 6, the effective suction area is large in the former half of the suction stroke and is small in the latter half of the suction stroke. In particular, the state of condition in patterns 2 to 5 is compatible with the condition of low torque at low speed, to which the present invention is directed.

In the embodiment as shown in FIG. 2, the effective area of the suction groove 18 is smaller than that of the suction port 17, contrary to the state of pattern 1.

Hereinunder, an explanation will be made as to an analysis which was conducted to minutely grasp the transient characteristics of the refrigerant pressure which constitutes an important feature of the invention.

The transient characteristics of the refrigerant pressure in the vane chamber is expressed by the following formula (1).

$$\frac{Cp}{A}GT_A - Pa\frac{dVa}{dt} + \frac{dQ}{dt} = \frac{d}{dt}\left(\frac{Cv}{A}\gamma aVaTa\right) \quad (1)$$

In the formula (1) above, G represents the flow rate of refrigerant in terms of weight, Va represents the volume of vane chamber, A represents the thermal equivalent of work, Cp represents the specific heat at constant pressure, $T_A$ represents the refrigerant temperature at supply side, K represents the specific heat ratio, R represents the gas constant, Cv represents the specific heat at constant volume, Pa represents the pressure in the vane chamber, Q represents the calorie, $\gamma a$ represents the specific weight of refrigerant in the vane chamber and Ta represents the temperature of refrigerant in the vane chamber. At the same time, in the following formulae (2) to (4), a represents the effective suction passage area, g represents the gravity acceleration, $\gamma A$ represents the specific weight of refrigerant at supply side and Ps represents the refrigerant pressure at supply side.

In the formula 1, the first term of the left side represents the heat energy of refrigerant brought into the vane chamber past the suction port per unit time, the second term represents the work performed by the refrigerant pressure per unit time and the third term represents the heat energy introduced from outside through the wall per unit time. On the other hand, the right side of the formula represents the increase of internal energy of the system per unit time. Assuming that the refrigerant follows the law of ideal gas and that the suction stroke of the compressor is achieved in quite a short time as an adiabatic change, the following formula (2) is derived from the formula (1) using the relationship of $\gamma a=Pa/RTa$, $dQ/dt=0$.

$$G = \frac{dVa}{dt}\left(\frac{A}{CpT_A} + \frac{1}{kRT_A}\right)Pa + \frac{Va}{kRT_A}\frac{dPa}{dt} \quad (2)$$

Also, the following formula (3) is obtained by using the relationship of $(1/R)=(A/Cp)+(1/kR)$.

$$G = \frac{1}{PT_A}\cdot\frac{dVa}{dt}\cdot Pa + \frac{Va}{kRT_A}\frac{dPa}{dt} \quad (3)$$

Known nozzle theory can be applied to the flow rate by weight of the refrigerant passing the suction port, so that the following equation (4) is derived.

$$G = a\sqrt{2g\gamma_A Ps\frac{k}{k-1}\left[\left(\frac{Pa}{Ps}\right)^{\frac{2}{k}} - \left(\frac{Pa}{Ps}\right)^{\frac{k+1}{k}}\right]} \quad (4)$$

It is, therefore, possible to obtain the transient characteristics of the pressure Pa in the vane chamber, by solving the formulae (3) and (4) in relation to each other. The volume $Va(\theta)$ of the vane chamber can be obtained through the following formula (5) in which m represents the ratio Rr/Rc.

$$V(\theta) = \frac{bRc^2}{2}\left\{(1-m^2)\theta + \frac{(1+m)^2}{2}\sin 2\theta - (1-m)\sin\theta \times \sqrt{1-(1-m)^2\sin^2\theta} - \sin^{-1}[(1-m)\sin\theta]\right\} + \Delta V(\theta) \quad (5)$$

Thus, the volume $Va(\theta)$ is represented by $Va(\theta)=V(\theta)$ when the angular position of the vane falls within the region of $0<\theta<\pi$ and by $Va(\theta)=V(\theta)-V(\theta-\pi)$ when the angular position falls within the range of $\pi<\theta<\theta s$.

The term $\Delta V(\theta)$ is a compensation term for compensating for the influence of the eccentric arrangement of vanes relatively to the center of the rotor. The value of this term, however, is generally as small as 1 to 2%.

FIG. 2 shows the transient characteristics of the pressure in the vane chamber in the case of pattern 3 as shown in FIG. 6, which characteristics is found using the formulae 3 to 5, the numerical data in Table 1, Table 2 (pattern 3), Table 3 under the initial condition of $t=0$ and $Pa=Ps$ with rotor revolutions per minute as the parameter. Since freon R12 is usually used as the refrigerant in an automobile air conditioner, the analysis was made on the assumption of $k=1.13$, $R=668$ Kg.cm/°Kkg, $\gamma A=16.8\times10^{-6}$ Kg/cm$^3$ and $T_A=283°$ K.

Figure 7:
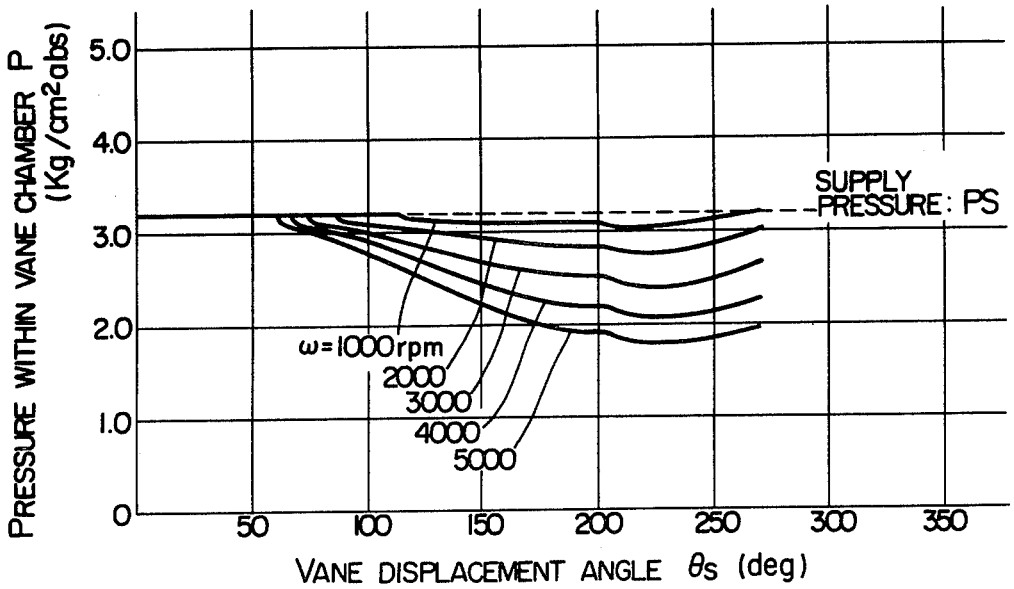
FIGS. 7 to 9 show relationships between pressure within vane chamber and vane displacement angle.

Referring to FIG. 7, the pressure Pa in the vane chamber has reached the level of the supply pressure of $Ps=3.18$ Kg/cm$^2$ abs when the vane is moved near the angular position of $\theta=2700°$ which is the point before the completion of the suction stroke, so that no substantial loss of pressure in the vane chamber is caused at the moment of completion of the suction stroke.

However, as the speed of revolution is increased, the supply of the refrigerant fails to follow up the change of volume in the vane chamber, so that the pressure loss at the point of completion of the suction stroke ($\theta=270°$) is gradually increased. For instance, a pressure loss of $P=1.30$ Kg/cm$^2$ is caused from the supply pressure Ps when the speed of revolution $\omega$ is 5000 rpm. In consequence, the total weight of the sucked refrigerant is lowered which considerably lowers the refrigerating capacity.

TABLE 3

| Parameters | Symbol | Embodiment |
|---|---|---|
| Refrigerant pressure at supply side | Ps | 3.18 Kg/cm$^2$ abs |
| Refrigerant temperature at sunny side | $T_A$ | 283° K. |
| Refrigerant pressure at discharge side | $P_d$ | 15.51 Kg/cm$^2$ abs |
| Speed of revolution | $\omega$ | 600 to 5000 rpm |

Figure 8:
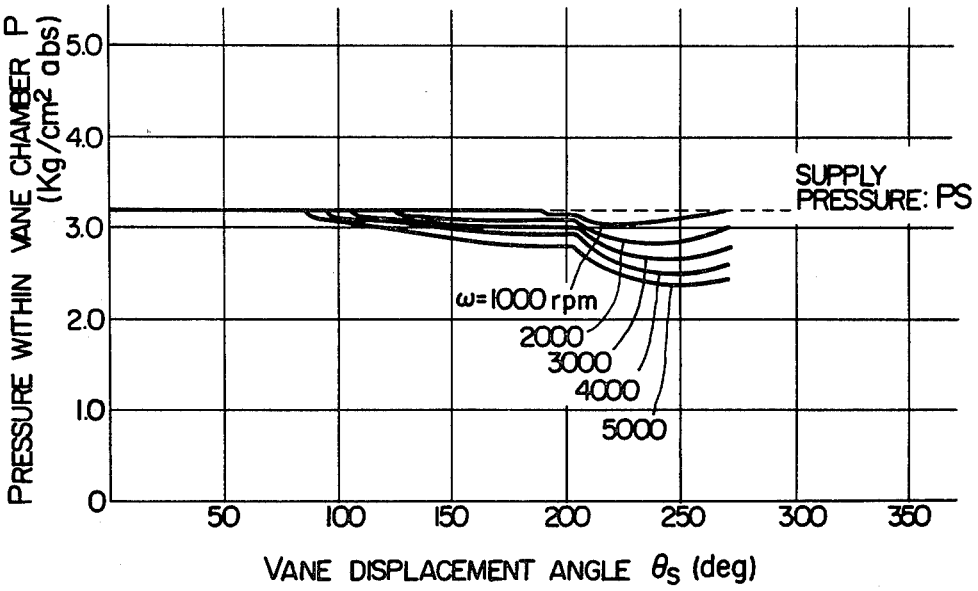
Figure 9:
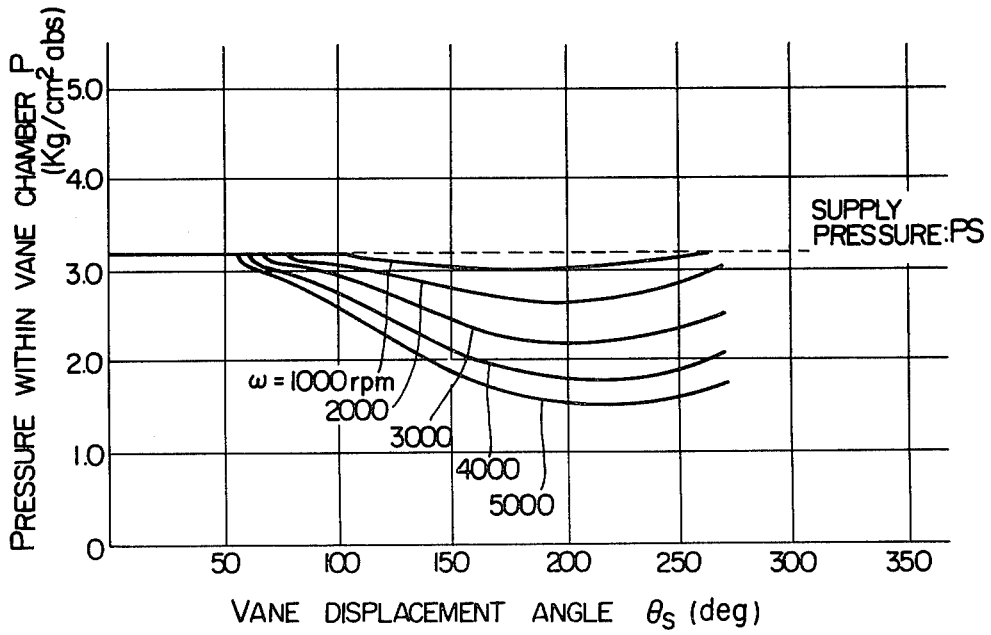

Referring to FIGS. 8 and 9, pressure within the vane chamber is plotted relative to vane displacement angle when the effective suction passage area is as shown by (6) and (1) in FIG. 6, respectively.

Representing the pressure Pa in the vane chamber at the time of completion of the suction stroke by Pa=Pas, the rate of pressure drop $\eta p$ is defined as follows.

$$\eta p = \left(1 - \frac{Pas}{Ps}\right) \times 100 \quad (6)$$

Figure 10:
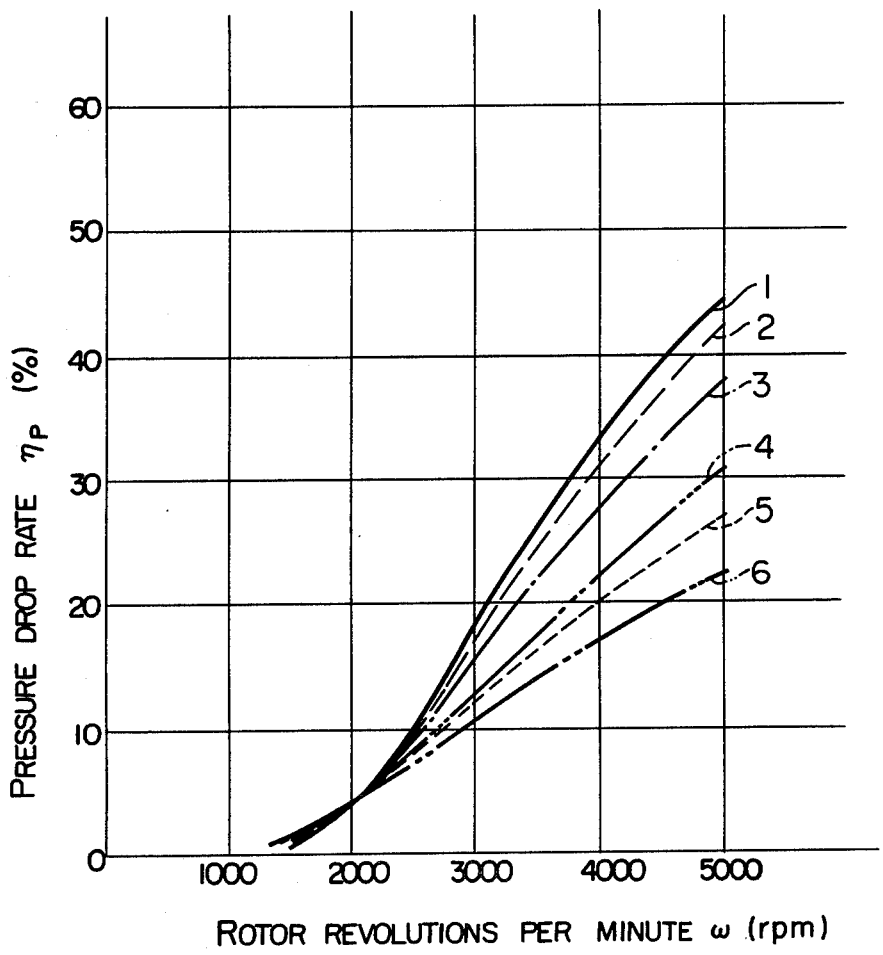
FIG. 10 is a graph showing pressure drop rate relative to rotor revolutions per minute.

FIG. 10 shows the rate of pressure drop $\eta p$ plotted against rotor revolutions per minute when the effective suction passage area is different as shown by (1) to (6) in FIG. 6. The following has been found from FIG. 10:

(1) In low rotor revolutions $\omega$ per minute of 2000 rpm, compressors having effective suction passage area (1) to (6) in FIG. 6 have pressure drop rates substantially in common:

(2) In high rotor revolutions $\omega$ per minute of 5000 rpm, the compressor as shown by (1) of FIG. 6 in which the effective suction passage area is constant during suction stroke has the largest pressure drop rate:

(3) The compressor having specifications of Table 1 and an effective suction passage area as shown by (3) of FIG. 6 has characteristics similar to that of the compressor having an effective suction passage area as shown by (1) of FIG. 6, and the compressor having an effective suction passage area as shown by (6) of FIG. 6 has a substantially small pressure drop rate $7_p$ which rate results from capacity control.

It may be recognized that the above pressure drop rate is substantially equal to a drop rate of the total weight of refrigerant which is filled in the vane chamber at the completion of the suction stroke.

Accordingly, a substantially satisfactory refrigerating capacity control in terms of only a controlled variable of refrigerant can be obtained in the compressor in which the pressure drop rate relative to rotor revolutions per minute exhibits such characteristics as shown by a curve (3) in FIG. 10.

(i) Reduction in refrigerating capacity due to suction loss was small at low rotor revolutions per minute.

Reciprocating compressors having a self-suppressing action for refrigerating capacity have a feature of a small suction loss at low rotor revolutions per minute. The rotary compressor according to the present invention exhibits characteristics which are by no means inferior to that of reciprocating compressors.

(ii) A refrigerating capacity suppressing effect which is equivalent to or greater than that of conventional reciprocating compressors was obtained at high rotor revolutions per minute.

(iii) The refrigerating capacity suppressing effect came forth when rotor revolutions per minute were increased to 1800 to 2000 rpm. When the compressor according to the embodiment of the present invention was used as a compressor for an automobile air conditioner, the refrigerating cycle which was satisfactory in terms of energy saving and smooth operation could be effected.

(iv) Driving torque was reduced substantially in proportion to rotor revolutions per minute to provide a substantial energy saving effect at low and high rotor revolutions per minute.

The above effects (i) to (iii) have already been provided in the invention of Japanese Patent Application No. 134048/1980, and constitute a marked feature of the present invention in that they can be attained without any addition of new elements or parts.

Thus, the present invention provides a compressor having a capacity control while maintaining advantageous features of rotary compressors which are small-sized, light and simple in constitution.

A refrigerating capacity controlling method has been put into practical use in the field of a refrigeration cycle of a room air conditioner which has a control valve connected between the high-pressure side and the low-pressure side of a compressor which is selectively opened to relieve the high-pressure refrigerant to the low-pressure side thereby to prevent excessive cooling. This control method, however, suffers a compression loss due to an irreversible re-expansion of the refrigerant at the low-pressure side, resulting in a reduction of the efficiency of the refrigeration cycle.

The rotary compressor of the invention is free from such a problem because the refrigerating capacity is controlled without any wasteful mechanical work which would impede the compression loss. In addition, the rotary compressor of the invention is characterized, as will be fully explained later, by an effective use of the transient characteristics of the vane chamber pressure by suitable combination of various parameters of the compressor. It is, therefore, not necessary to employ any mechanically moving part such as the control valve. This is turn ensures a high reliability of operation of the compressor.

Furthermore, according to the invention, the unnatural feel of air conditioning a discontinuous changing of the refrigerating capacity, which is inevitable in the refrigeration cycle having a capacity controlling valve, is eliminated thanks to the continuous and smooth change of the refrigerating capacity. This of course leads to a comfortable feel for passengers of an automobile.

Figure 11:
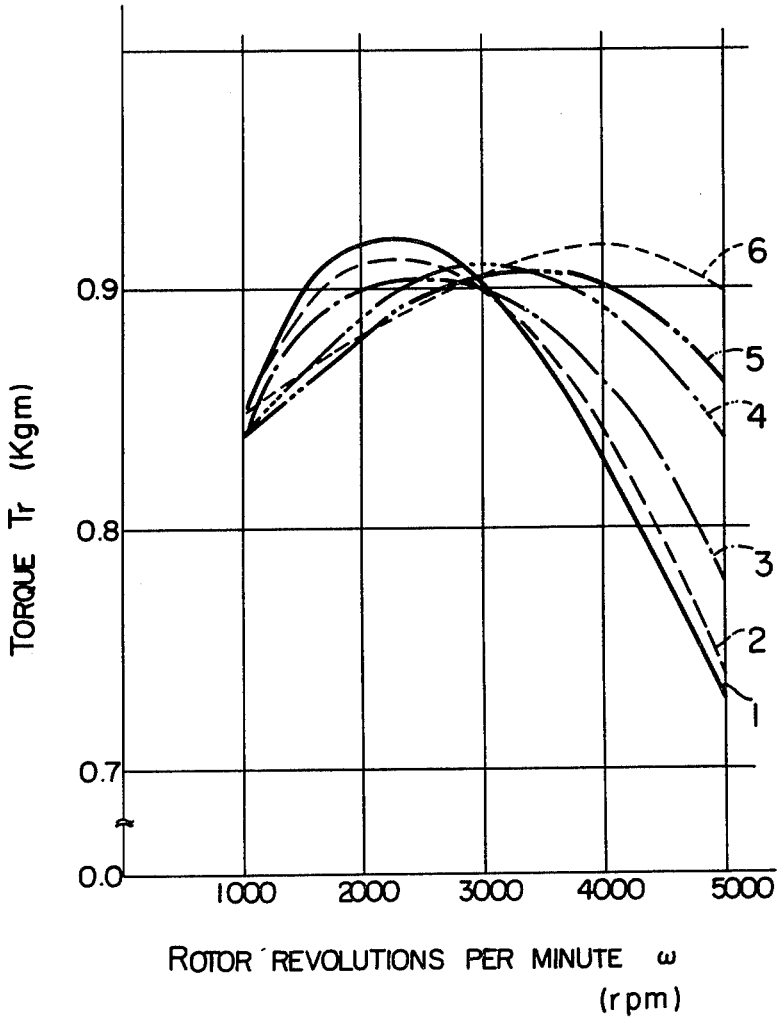
FIG. 11 is a graph showing torque relative to rotor revolutions per minute.

The present invention has in addition to the above features (i) to (iii) a feature in providing compressors (having low power consumption at low speed operation) suitable for small automobiles which compressors have much frequency in use at low rotor revolutions per minute ($\omega$=1000 to 2000 rpm). FIG. 11 shows a plot of driving torque against rotor revolutions per minute in a case where the effective suction area is different (as shown in the cases (1) to (6) in FIG. 6) with the effective area of the discharge port a=0.21 cm$^2$.

In performing capacity control, the driving torque of the compressor consists of the following components:

(1) Loss during suction stroke (2) Compression power during compression stroke (3) Loss due to over-compression With reference to FIGS. 12 and 13, the above components (1) to (3) will be explained hereinbelow.

Figure 12:
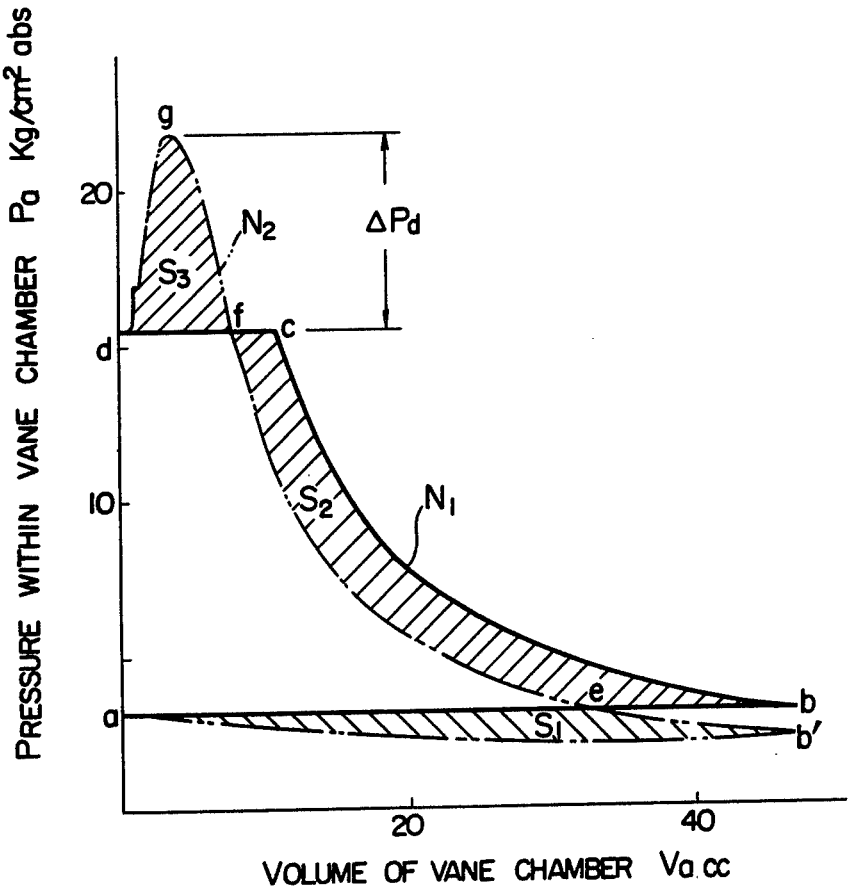
FIG. 12 is a PV diagram where the effective suction area is constant.

In FIG. 12, a curve $N_1$ represented by points a, b, c and d corresponds to normal polytropic suction and compression strokes. A curve $N_2$ represented by points a, b', e, f, g and d corresponds to the case in which capacity control is effected with the effective suction area being constant during the suction stroke, and is a PV diagram, for example, in the case (1) of FIG. 6.

In the case of capacity control, the pressure Pa within the vane chamber at the start of the compression stroke is reduced as rotor revolutions per minute are increased.

Without any capacity control, the pressure Pa within the vane chamber at the start of the compression stroke, that is, at the point b of Va=47 cc (or at the completion of suction stroke) is constant irrespective of rotor revolutions per minute since refrigerant is completely filled in the vane chamber 26*a* (FIG. 4).

Figure 13:
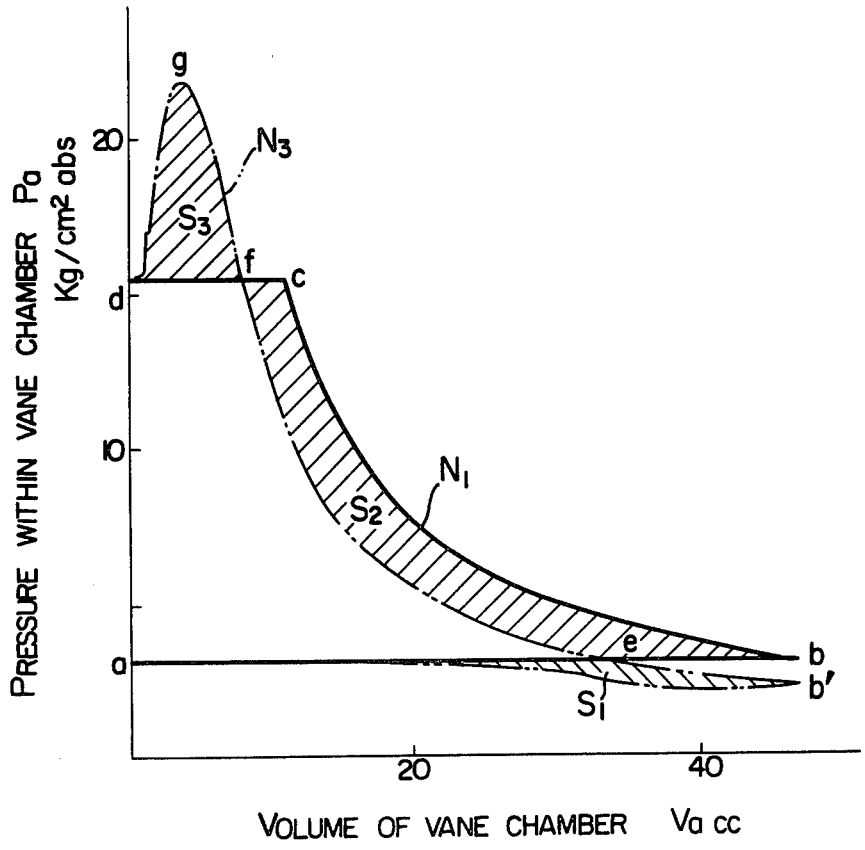
FIG. 13 s a PV diagram in the embodiment of the present invention.

In FIG. 13, a curve $N_3$ shows a PV diagram which corresponds to the cases (2) to (6) of FIG. 6 where the effective suction area varies in two stages. In the drawing, area $S_1$ represents a power loss during suction stroke, area $S_2$ a reduction in compression power due to the effect of capacity control, and area $S_3$ a loss in over-compression power. In case the effective suction area is constant (the case (1) in FIG. 6), the power loss $S_1$ (FIG. 12) is large since the pressure Pa within the vane chamber starts to decrease while the volume Va of the vane chamber is still small. In case the effective suction area is large in the former half of the suction stroke and is small in the latter half of the suction stroke (for example, the case (3) in FIG. 6), however, the suction loss $S_1$ (FIG. 13) is generally small as compared with the former case since the drop of the pressure Pa within the vane chamber is small in the former half of the stroke.

Figure 14:
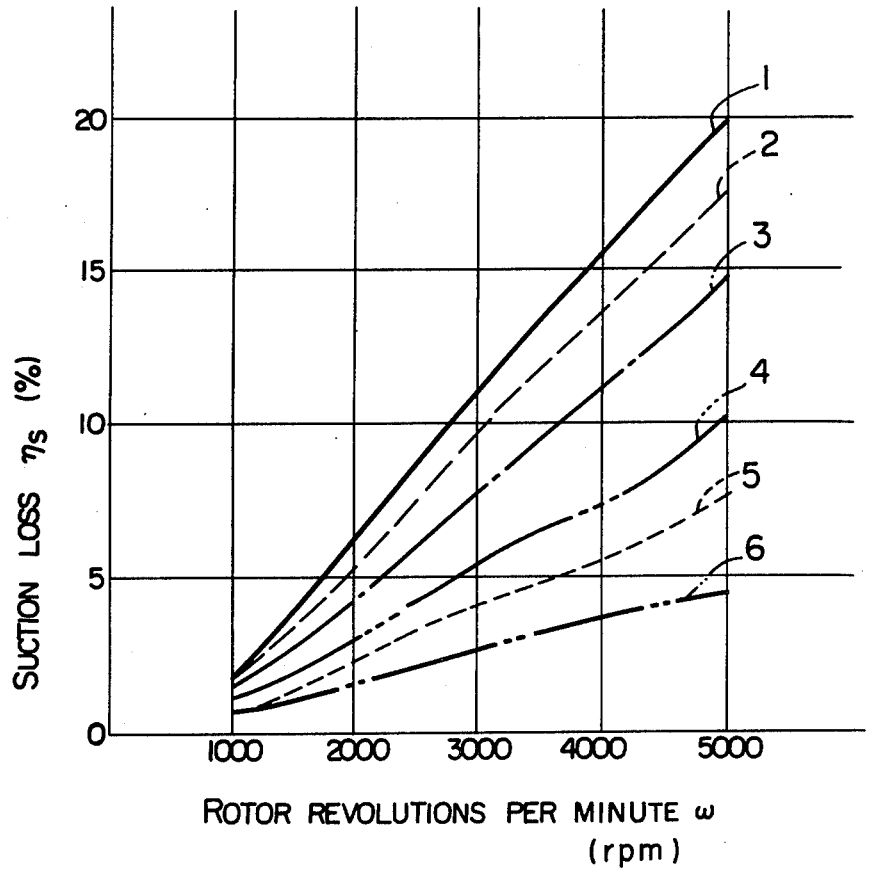
FIG. 14 is a graph showing suction loss relative to rotor revolutions per minute.
Figure 15:
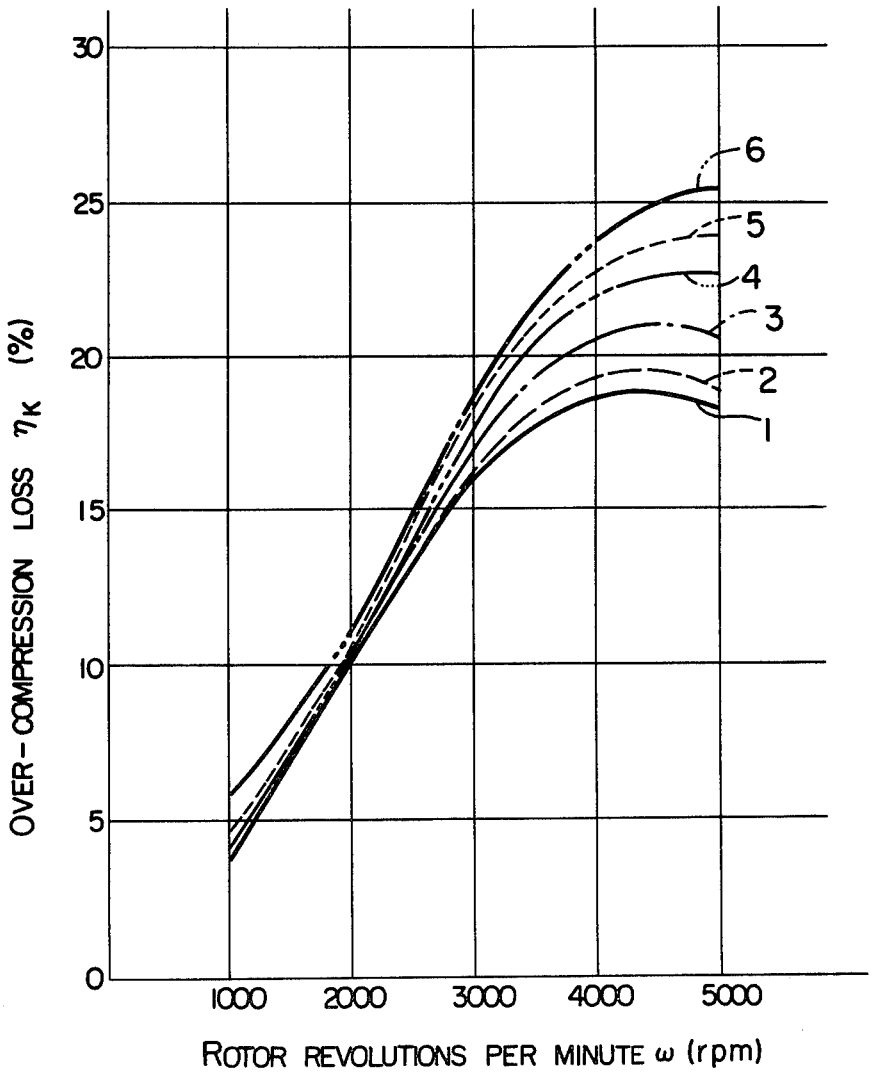
FIG. 15 is a graph showing overcompression loss relative to rotor revolutions per minute.

FIGS. 14 and 15 show plots of suction loss and over-compression loss against rotor revolutions per minute in the cases (1) to (6) of FIG. 6. As seen from the drawings, it is found that as a change in the effective suction area becomes small during the suction stroke, the suction loss is large and the over-compression loss is conversely large.

The aims of the present invention are summarized as follows:

(1) Loss in refrigerating capacity is reduced at low rotor revolutions per minute (1000 to 2000 rpm).

(2) A great suppressing effect is obtained at high rotor revolutions per minute (35000 to 5000 rpm).

(3) Driving is effected at low torque, in particular, at low rotor revolutions per minute.

While the above results are obtained in the particular cases where compressors have parameters as described in Tables 1 and 2, those corelations will be hereinbelow studied which satisfy all of the above aims (1) to (3) at the same time and under which general constituent conditions or parameters of the compressor are set. Therefore, it is proposed to rearrange the formulae (3) and (4) by using the following approximate function instead of the formula (5) for finding the volume Va of the vane chamber and to catch correlations between the respective parameters and the effects of capacity control.

Representing the maximum suction volume by Vo and transforming the angle $\theta$ into $\phi$ using a relationship of $\phi = Qt = (\pi\omega/\theta_s)t$, the following approximate function (7) is selected on condition that $\phi$ is varied between 0 and $\pi$, Va(0)=0 and Va'(0) at the moment t=0 and, at the moment $t=\theta_s/\omega$ at which the suction stroke terminates, $Va(\pi)=Vo$ and $Va'(\pi)=0$, respectively.

$$Va(\phi) \approx \frac{Vo}{2}(1 - \cos\phi) \tag{7}$$

The following formula (8) is obtained by expressing the ratio Pa/Ps by $\eta$.

$$G = \frac{\Omega Vo}{2}\ \frac{Ps}{RT_A}\{\sin\phi \cdot \eta + \frac{1}{k}(1 - \cos\phi)\frac{d\eta}{d\phi} \tag{8}$$

Also, the formula (4) can be transformed into the following formula (9).

$$G = a\sqrt{Ps \cdot \gamma_A 2g \cdot \frac{k}{k-1}\left[\eta^{\frac{2}{k}} - \eta^{\frac{k+1}{k}}\right]} \tag{9}$$

Therefore, the following formula (10) is derived from the formulae (7) and (8) above.

$$K_1 f(\eta) = \sin\phi \cdot \eta + \frac{1}{k}(1 - \cos\phi)\frac{d\eta}{d\phi} \tag{10}$$

The factor $K_1$ is a value having no dimension, expressed by the following formula (11).

$$K_1 = \frac{2a\theta_s}{Vo\pi\omega} \cdot \sqrt{2gRT_A} \tag{11}$$

In the case of sliding vane type rotary compressor, the following relationship exists between the number of vanes n and the theoretical discharge rate Vth.

$$Vth = n \times Vo$$

The formula (10), therefore, can be transformed into the following formula (12).

$$K_1 = \frac{2a\theta_s n}{Vth\pi\omega}\ \sqrt{2gRT_A} \tag{12}$$

In the formula (11) above, the specific heat ratio K is determined solely by the kind of refrigerant. In the above formula (12), the effective suction area a is a function of non-dimensional vane displacement angle $\phi$, and the parameter $K_1$ is therefore a function of $\phi$. Therefore, under the condition in which the factor $K_1$ takes a constant value, the solution of the formula (9), i.e. $n=\eta(\phi)$, is determined univocally.

Here, using the effective suction area $a_1$ and $a_2$ in the former and latter halves of the suction stroke, parameters $K_{21}$ and $K_{22}$ are defined as follows.

$$K_{21} = \frac{a_1 \cdot \theta_s}{Vo} \tag{13}$$

$$K_{22} = \frac{a_2 \cdot \theta_s}{Vo} \tag{14}$$

The following is found from the analysis of the result of FIGS. 6 and 10. When the effective suction area $a_1$ or $K_{21}$ is widely varied, the compression loss $7_p$ is influenced thereby at high speed operation, but is not so much influenced at low speed operation. For example, at $\omega=2000$ rpm, the compression loss $7_p$ can be made constant only by performing a slight correction (0.385 $cm^2<a_2<0.450$ $cm^2$) for the effective suction area $a_2$ in the latter half of suction stroke (or $K_{22}$).

The cases as described herein below will then be analyzed in order to determine how the pressure drop rate $7_p$ is changed relative to rotor revolutions per minute with the effective suction area $a_2$ (or $K_{22}$) in the latter half of suction stroke.

Figure 16:
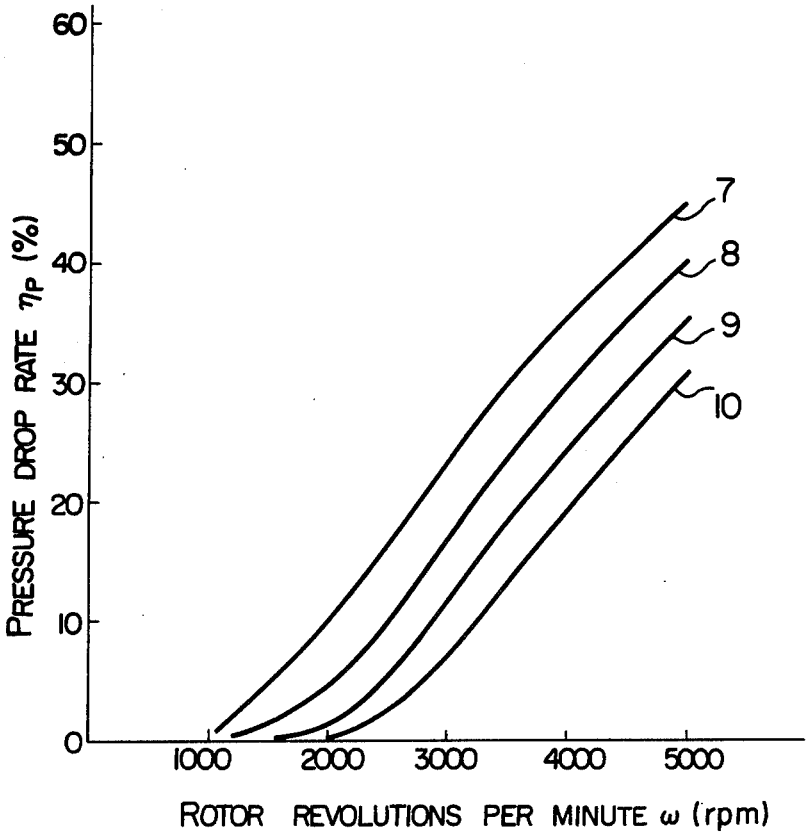
FIG. 16 is a graph showing pressure drop rate relative to rotor revolutions per minute when the effective suction area in the latter stage is changed.

FIG. 16 shows characteristics of the pressure drop rate $7_p$ relative to when the effective suction area $a_2$ is varied under the respective conditions of Table 4 with the effective suction area in the former half of the suction stroke maintained constant, that is $a_1=0.6$ cm.

TABLE 4

| | $a_2$: effective suction area in the latter half of suction stroke | $K_{22}$ |
|---|---|---|
| 7 | 0.30 $cm^2$ | 0.030 |
| 8 | 0.40 | 0.040 |
| 9 | 0.50 | 0.050 |
| 10 | 0.60 | 0.060 |

Figure 17:
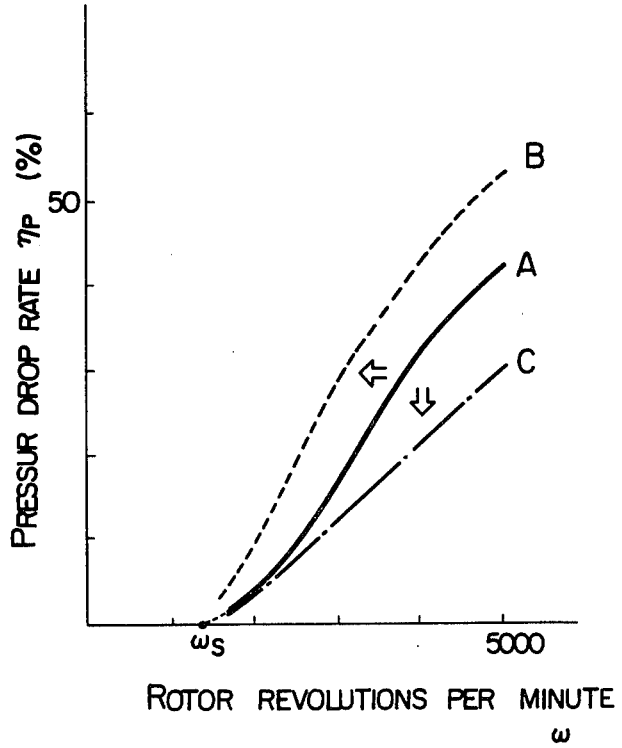
FIG. 17 is a graph showing a tendency in changes of a characteristics curve of the compressor when the effective suction area is changed in the former and latter stages, respectively.

Converting $a_1$ and $a_2$ to $K_{21}$ and $K_{22}$ by the use of the formula (13) and (14), and using a model diagram of FIG. 17, the above result is summarized as follows:

(1) When $K_{21}$ is changed, the pressure drop rate $7_p$ tends to be varied relative to rotor revolutions $\omega$ per minute in the manner A to C in FIG. 17.

(2) When $K_{22}$ is changed, the curve representing a plot of the pressure drop rate $7_p$ relative to $\omega$ experiences parallel displacement from A to B in FIG. 17.

As seen from FIG. 6, with the embodiment according to the present invention, the effective suction area in the former half of the suction stroke practically ranges from (1) to (6), that is, 0.45 $cm^2<a<1.4$ $cm^2$. The result of the embodiment is generalized as follows using the parameter $K_{21}$.

$$K_{22}<K_{21}<0.140 \quad (15)$$

In case the effective suction area a is constant during suction stroke, parameter $K_1(\phi)$ obtained from the formula (12) becomes constant. When the effective suction area is constant, the following parameter $K_2$ is again defined as follows:

$$K_2=(a\theta_s/Vo) \quad (16)$$

Figure 18:
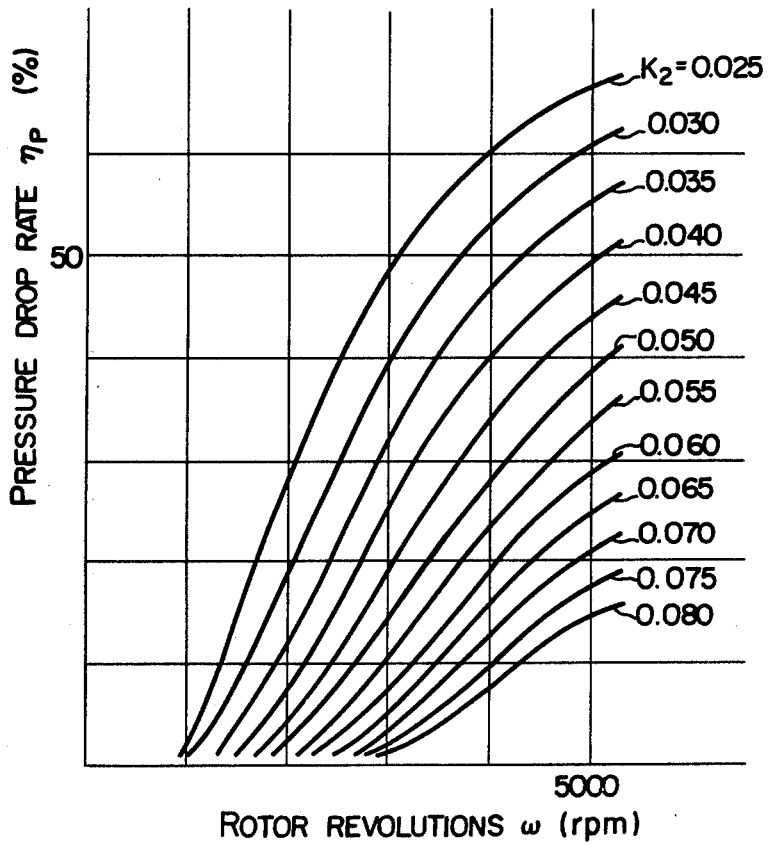
FIG. 18 is a graph showing pressure drop rate relative to rotor revolutions per minute when the effective suction area is constant in suction stroke.

FIG. 18 shows a plot of pressure drop rate $7_p$ against rotor revolutions $\omega$ per minute which plot is rearranged with respect to the parameter $K_2$ and is obtained by solving the formulae (3) and (4) under the condition of $T=283°$ K. with $\Delta T=10$ deg as superheat in case the effective suction area is maintained constant during the suction stroke. As apparent from the comparison of FIGS. 16 and 18, values of rotor revolutions $\omega$ per minute when $7_p\simeq 0$ are equal to each other in the cases of curves where $K_{22}$ is the same as $K_2$ although the parameter $K_{21}$ in the former half of the suction stroke is different from $K_2$. More specifically, it is found that the rotor revolutions $\omega_s$ per minute at which capacity control is started is independent of the effective suction area $a_1$ in the former half of the suction stroke or $K_{21}$, but is largely dependent upon the effective suction area $a_2$ in the latter half of the suction stroke or parameter $K_{22}$. (FIG. 17 should be referred to in regard to $\omega_s$.)

Rotational frequency $\omega_1$ of the engine at the idling of a vehicle is normally set at 800 to 1000 rpm. Additionally, the rotational frequency $\omega_2$ of the engine is 1800 to 2200 rpm when the travelling speed of the vehicle is 40 km/h. As a result of applying the embodiment of the present invention to conventional vehicles, there was much demand for the start of capacity control to be set in the range of $\omega_1<\omega_s<\omega_2$.

The parameter $K_{22}$ ranges as follows in light of FIG. 18.

$$0.025<K_{22}<0.055 \quad (17)$$

Respective average values may be used as the effective suction areas $a_1$ and $a_2$ in calculating the formulae (15) and (17).

As described above, compressors constructed in accordance with the embodiment of the present invention could provide a satisfactory capacity controlling effect at low torque and low speed operation, and even at high speed operation if the formulae (15) and (17) were together satisfied.

Figure 19:
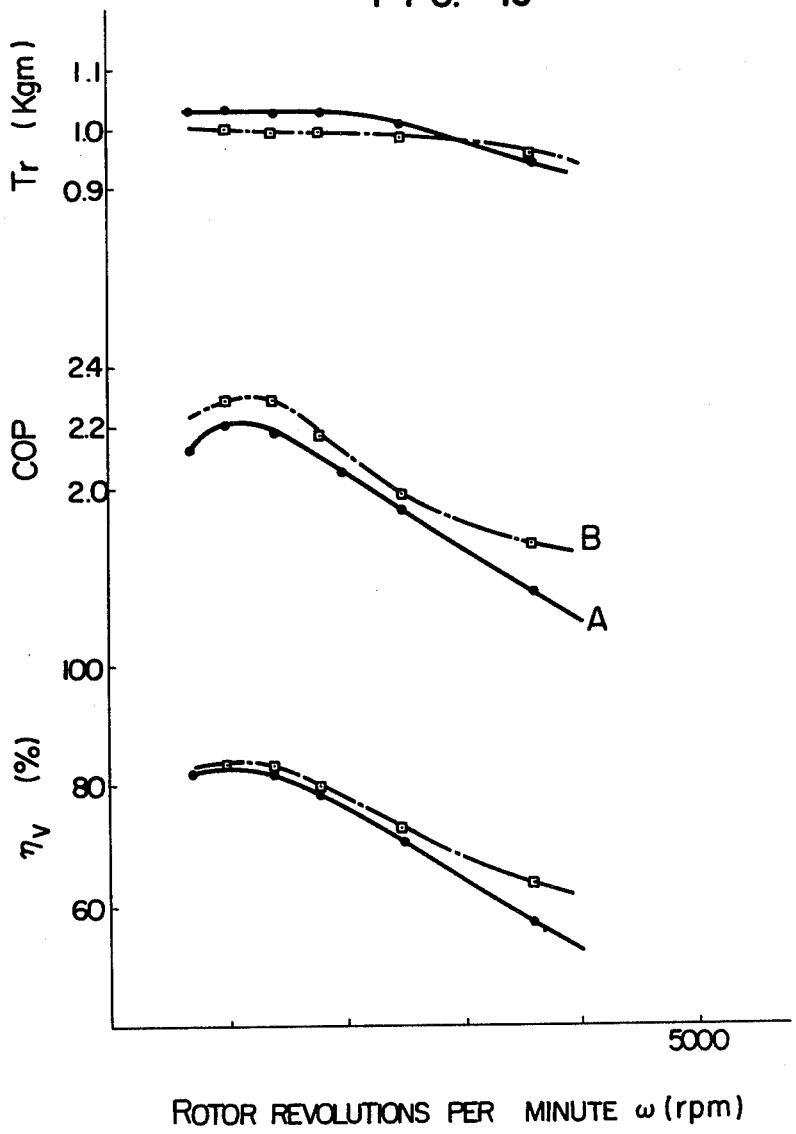
FIG. 19 is a graph showing exemplifying data of measurements taken by a calorimeter to substantiate the present invention.

FIG. 19 shows an example of measurements by a calorimeter to substantiate principles of the present invention. In the drawing, data of measurement as shown by solid lines correspond to the condition in which the effective suction area during suction stroke exhibits a relatively small stepwise change, and data of measurement as shown by alternate long and short lines correspond to the condition in which the effective suction area during suction stroke exhibits a relatively large stepwise change. Denoting the compressor of the former condition by character A and the compressor of the latter condition by character B, torque Tr of the compressor A is higher than that of the compressor B at low speed operation, but is lower that of the compressor B at high speed operation, which is seen to support the result of analysis as shown in FIG. 26. Suction losses (evaluated in regard to the volumetric efficiency $\eta_v$) in both of the compressors A and B at low rotor revolutions $\omega$ per minute of 1000 to 2000 rpm make no great difference to each other with the result that the compressor B is seen to be superior to the compressor A in terms of coefficient of performance COP.

The result of analysis as described above is related to the condition in which temperature $T_A$ at the supply side of refrigerant is 283° K. However, the appropriate ranges of the parameters $K_{21}$ and $K_{22}$ are somewhat varied dependent upon settings of the temperature $T_A$.

When freon R12 is used as the refrigerant in refrigeration cycle of an automobile air conditioner, the evaporating temperature $T_A$ of the refrigerant is determined taking the following matters into account.

The rate of heat exchange in the evaporator is greater as the temperature difference between the external air and the circulated refrigerant is increased. It is, therefore, preferred to lower the refrigerant temperature $T_A$. However, if the refrigerant temperature is set at a level below the freezing point of moisture in the air, the moisture in the air is inconveniently frozen on the pipe to seriously affect the heat exchange efficiency. Therefore, it is preferable to set the refrigerant temperature at such a level as to provide a pipe surface temperature above the freezing point of the moisture in the air. The best set temperature $T_A$ of the refrigerant is ground −5° C. provided that the air is allowed to flow at a sufficiently large flow rate, and the practically acceptable lower limit of the set temperature $T_A$ of the refrigerant is around −10° C. The evaporation temperature of the refrigerant is higher during the low-speed running of the automobile or during idling in which the condition for heat exchange is rather inferior. Although the rate of heat exchange can be increased by increasing the flow rate of air by increasing the power of the blower or, alternatively, through increasing the surface area of the evaporator, these measures, however, are practically limited because of installation problems. Therefore, the practically acceptable upper limit of the refrigerant temperature $T_A$ is around 10° C. More preferably, the refrigerant temperature is maintained below 5° C. Thus, for obtaining a practically acceptable refrigeration cycle, the refrigerant temperature $T_A$ should be selected to meet the following condition.

$$-10°\text{ C.} < T_A < 10°\text{ C.} \quad (18)$$

For information, the refrigerant supply pressure Ps meeting the above-specified condition is calculated as follows.

$$2.26\text{ Kg/cm}^2\text{abs} < Ps < 4.26\text{ Kg/cm}^2\text{abs} \quad (19)$$

Furthermore, superheat $\Delta T = 10$ deg is taken into account with relative to $T_A$ of formula (21).

$$0°\text{ C.} < T_A < 20°\text{ C.} \quad (20)$$

For example, the ranges of the parameters $K_{21}$ and $K_{22}$ determined by the formulae (15) and (17) can be corrected by the formula (23) such that the upper limit values of the parameters are on the large side by 1.8% and the lower limit values of the parameters are on the small side by 1.7%.

In the present invention, the effective area of the suction passage is a concept as explained below.

The approximate value of the effective area of suction passage a can be grasped as a value which is a multiple of the minimum cross-sectional area in the fluid passage between the evaporator outlet and the vane chamber and a contracting coefficient C which is generally between 0.7 and 0.9, if such a minimum cross-section exists in the fluid passage. More particularly, however, the value obtained through experiment conducted following a method specified in, for example, JIS B 8320 is defined as the effective area of suction passage.

Figure 20:
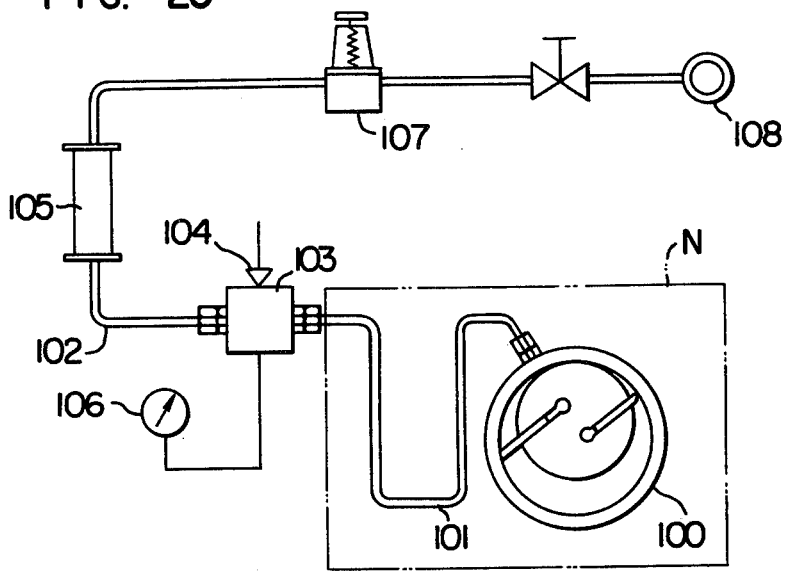
FIG. 20 is diagramatical view of an experimental system for measuring the effective suction area.

FIG. 20 shows an example of such experiments. In FIG. 20, reference numeral 100 denotes a compressor, 101 denotes a pipe for connecting the evaporator to the suction port of the compressor when the evaporator and the compressor are mounted on an actual automobile, 102 denotes a pipe for supplying pressurized air, 103 denotes a housing for connecting the pipes 101 and 102 to each other, 104 denotes a thermocouple, 105 denotes a flow meter, 106 denotes a pressure gauge, 107 denotes a pressure regulator valve and 108 denotes a source of pressurized air.

The section surrounded by one-dot-and-dash line in FIG. 20 corresponds to the compressor of the invention. However, if there is any restricting portion which imposes an innegligible flow resistance in the evaporator, it is necessary to add a restriction corresponding to such restricting portion to the pipe 101.

For measuring the effective area of suction passage a of the compressor having the construction as shown in FIG. 3, the experiment is conducted with the disc 24 and pulley 25 of the clutch demounted and with the front panel 20 detached from the cylinder 11.

The effective area of suction passage a is determined by the following formula (21), representing the pressure of the pressurized air by $P_1$ Kg/cm² abs, atmospheric pressure by $P_2 = 1.03$ Kg/cm² abs, specific heat ratio of air by $K = 1.4$, specific weight of air by $\gamma_1$ and the gravity acceleration by $g = 980$ cm/sec².

$$a = G_1 / \sqrt{2g\gamma_1 P_1 \frac{K}{k_1 - 1}\left\{\left(\frac{P_2}{P_1}\right)^{\frac{2}{k1}} - \left(\frac{P_2}{P_1}\right)^{\frac{K1+1}{k1}}\right\}} \quad (21)$$

The pressure $P_1$ of the pressurized air should be selected to meet the condition $0.528 < P_2 < P_1 < 0.9$.

In the embodiment as shown in FIGS. 2 and 3, the cylinder 11 is formed at its inner surface with the suction groove 18, of which the effective suction area is smaller than that of the suction port 17 and is varied such that it becomes large in the former half of suction stroke and small in the latter half thereof.

Figure 21:
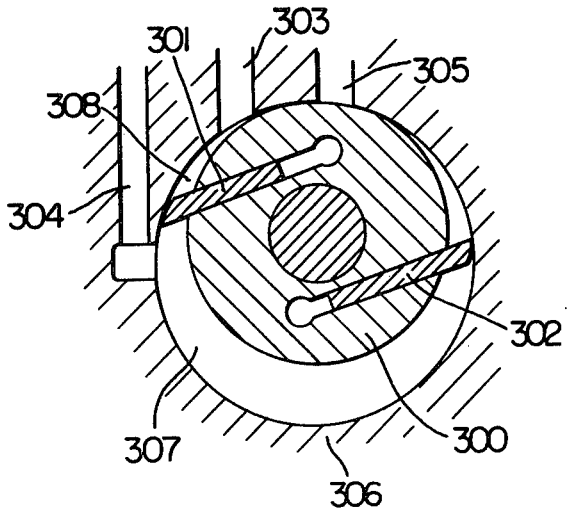
FIG. 21 is a sectional view of a compressor according to another embodiment of the present invention.

FIG. 21 shows another embodiment of the present invention, in which a rotor is designated by numeral 300, a pair of vanes by numerals 301 and 302, a suction port by numeral 303, a second suction port by numeral 304, a discharge port by numeral 305, a cylinder by numeral 306, a vane chamber by numeral 307 and a second chamber by numeral 308. With the above arrangement, refrigerant is fed into the vane chamber 308 only through the suction port 303 when the vane 301 is positioned at a point between the suction ports 303 and 304 immediately after the start of the suction stroke. When the vane 301 passes the suction port 304, refrigerant is fed into the vane chamber 308 through both of the suction ports 303 and 304. Thereafter, refrigerant is fed into the vane chamber 308 only through the suction port 304 when the vane 302 following the preceding vane 301 has passed the suction port 303. Accordingly, the effective area $a_1$ in the former half of the suction stroke consists of those of the suction ports 303 and 304, and the effective area $a_2$ in the latter half of the suction stroke consists of only that of the suction port 304.

In the above description, two vane type compressors have been explained by way of example, and the vane displacement angle $\theta_s$ at the completion of suction stroke is represented by the following formula where n is a number of the vanes:

$$\theta_s \approx 180 + 180/n$$

In case a suction groove is replaced by the suction port to thereby vary the effective suction area as in the embodiment of the present invention, the vane displacement angle $\theta_t$ when the effective suction area is reduced is represented by the following formula where $\alpha$ is an angle formed between the top portion of the cylinder and the suction port and is normally in the order of 10° to 30°.

$$\theta_t \approx 360/n + \alpha$$

In the embodiments described above, the present invention is applied to two vane type compressors which effectively embody features of the present invention for the following reason.

Referring to FIGS. 4B and 4C, refrigerant flows into the vane chamber 26a via the suction port 17 and vane chamber 26c before the completion of the suction stroke. In the two vane type compressor as shown in FIG. 4B, the volume $V_2$ of the vane chamber 26c on the upstream side is substantially smaller than the volume $V_1$ of the vane chamber 26a in the order of $V_2/V_1=8$ to 9% at the completion of the suction stroke. In contrast, the ratio $V_2/V_1$ is 45 to 50% in the case of four vane type compressors. While the increasing rate of the volume $V_2$ of the vane chamber 26a becomes zero at the completion of the suction stroke, the volume $V_1$ of the vane chamber 26c tends to increase rapidly. With the two vane type compressor, however, the volume $V_1$ of the vane chamber 26c is extremely small at the completion of the suction stroke to exert a slight influence on the compressive characteristics of the vane chamber 26a.

Figure 22:
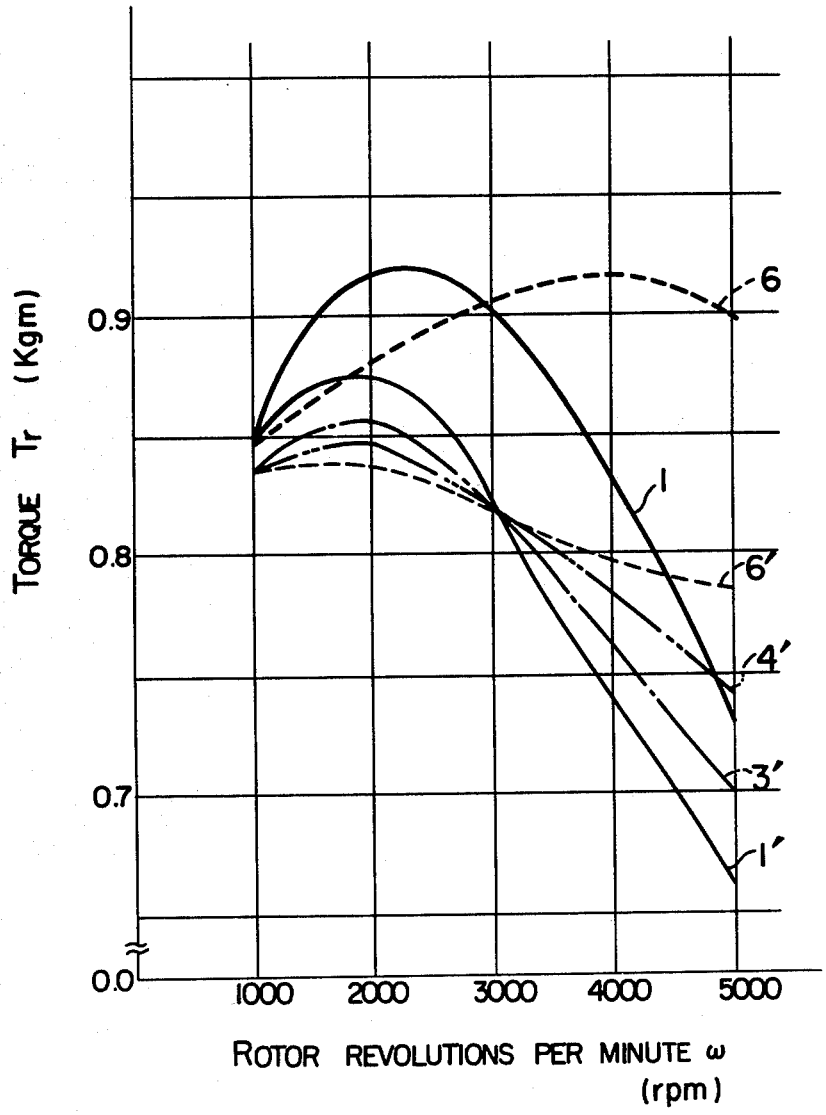
FIG. 22 is a graph showing torque relative to rotor revolutions per minute when an effective area of the discharge port is changed.

FIG. 22 shows a plot of torque Tr against rotor revolutions $\omega$ per minute in the case of the effective area a of the discharge port being 0.40 $cm^2$ which value is greater than that of the above embodiment. In the drawing, the patterns 1', 3', 4' and 6' of the suction area are the same as the patterns 1, 3, 4 and 6 in FIG. 6. As seen from FIG. 22, the general tendency remains unchanged while driving torque Tr is generally decreased as rotor revolutions per minute increase due to the fact that power for over-compression during the discharge stroke is reduced.

Although the invention has been described with specific reference to a sliding vane type rotary compressor having two vanes, the invention can be applied to any type of compressor regardless of the discharge rate and the number of vanes of the compressor. The invention can be applied also to the case where the vane has no eccentricity from the center of the rotor, although the eccentric arrangement of the vane is preferred for obtaining a large discharge rate. It is also possible to apply the invention to the compressors in which the vanes are arranged at an irregular angular interval. In such an application, the refrigerating capacity control in accordance with the invention should be effected on the vane chamber having greater maximum sucking volume Vo.

Although the cylinder is illustrated as having a circular cross-section, this is not essential and the cylinder can have any other cross-section such as an oval cross-section. The invention can be applied even to a single vane type compressor in which a single vane is slidably received by a slot formed diametrically in the rotor.

Thus the compressor of the present invention is constructed such that the effective suction area is varied in at least two steps during the suction stroke to have an appropriate difference between in the former and latter halves of the suction stroke and a combination of parameters of the compressor is set in an appropriate range to provide an effective capacity control, which parameters are determined by the mean effective suction area, amount of discharge, number of vanes and the like. Accordingly, the compressor of the present invention can be driven by low torque at low speed operation with a slight loss of refrigerating capacity and effectively suppress its refrigerating capacity at high speed operation.

According to the present invention, capacity control can be embodied without adding any parts to the construction of conventional compressors.

What is claimed is:

1. A compressor comprising a rotor having slidable vanes mounted thereon, a cylinder receiving therein said rotor and vanes, side plates secured to the opposite sides of said cylinder to close the opposite sides of a vane chamber defined by said vanes, said rotor and said cylinder, suction ports and a discharge port, the refrigerating capacity of said compressor being suppressed at high speed operation by improving a suction loss produced when the pressure within said vane chamber drops to a level lower than a pressure of a refrigerant supply source during a source stroke, said compressor being constructed such that the effective area of a flow passage leading from said suction port to said vane chamber is varied in at least two steps so as to become smaller in the latter half of a suction stroke than in the former half thereof and that the following inequalities $$K_{22}<K_{21}<0.140$$

$$0.025<K_{22}<0.055$$

are satisfied where $K_{21}-a_1\theta_s/Vo$ and $K_{22}=a_2\theta_s/Vo$ in which $\theta$ (radian) is an angle formed around the center of revolution of said rotor between the vane end portion adjacent to the inner surface of said cylinder and the top portion of said cylinder closest to said rotor, Vo (cc) is a volume of said vane chamber when said angle $\theta$ is $\theta_s$ (radian) at the completion of a suction stroke, $a_1$ ($cm^2$) is an average value of the effective area of a suction passage leading from an evaporator to said vane chamber in the former half of a suction stroke and $a_2$ ($cm^2$) is an average value of said effective area in the latter half of a suction stroke.

2. A compressor as set forth in claim 1 wherein the effective area $a_1$ in the former half of a suction stroke is determined by said suction stroke and the effective area $a_2$ is determined by an effective area of a nozzle which is defined by a suction groove formed on the inner surface of said cylinder and the vane moving on said suction groove.

* * * * *